United States Patent [19]

Kunzmann

[11] 4,230,218

[45] Oct. 28, 1980

[54] APPARATUS FOR TRANSPORTING LAYERS OF SHEETS

[75] Inventor: Otto Kunzmann, Neuffen, Fed. Rep. of Germany

[73] Assignee: Bielomatik Leuze & Co., Fed. Rep. of Germany

[21] Appl. No.: 909,248

[22] Filed: May 24, 1978

[30] Foreign Application Priority Data

Jun. 2, 1977 [DE] Fed. Rep. of Germany ..... 2724980

[51] Int. Cl.[3] ..... B65G 47/31; B65G 15/14; B65G 37/00

[52] U.S. Cl. ..... 198/461; 198/627; 198/604

[58] Field of Search ..... 198/461, 457, 627, 628, 198/604, 626, 836; 271/272–274, 198, 184, 12

[56] References Cited

U.S. PATENT DOCUMENTS

| | | | |
|---|---|---|---|
| 3,166,311 | 1/1965 | Rabinow et al. | 271/12 |
| 3,179,234 | 4/1965 | Bloom et al. | 198/457 |
| 3,250,375 | 5/1966 | Bonthuis et al. | 198/457 |
| 4,004,677 | 1/1977 | Heier et al. | 198/461 |

FOREIGN PATENT DOCUMENTS

| | | | |
|---|---|---|---|
| 1184698 | 12/1964 | Fed. Rep. of Germany | 198/628 |
| 2509520 | 9/1976 | Fed. Rep. of Germany | 198/461 |
| 977382 | 12/1964 | United Kingdom | 198/628 |

*Primary Examiner*—Joseph E. Valenza
*Assistant Examiner*—Brian Bond
*Attorney, Agent, or Firm*—Steele, Gould & Fried

[57] ABSTRACT

An apparatus is provided for transporting layers of sheets in which the layers of sheets are carried off discontinuously transversely to the direction in which they are supplied and follow the layers of sheets previously carried off. The apparatus comprises a belt conveyor running at a substantially constant velocity, and a belt run with upper and lower belts which is connected in front of the continuously running belt conveyor and overlaps it at least in part. The belt run may be driven intermittently at a velocity varying between standstill and a higher velocity than that of the belt conveyor. The distance between the upper and lower belts may be varied cyclically.

16 Claims, 6 Drawing Figures

APPARATUS FOR TRANSPORTING LAYERS OF SHEETS

FIELD OF THE INVENTION

The invention relates to an apparatus for transporting layers of sheets in which the layers of sheets are carried off discontinuously transversely to the direction in which they are supplied and follow the layers of sheets previously carried off. The apparatus includes a belt conveyor running at a substantially constant velocity.

BACKGROUND OF THE INVENTION

An apparatus of the type described above is normally required when a stream of adjacent and consecutive layers or stacks of sheets transported by belts or pushers are deposited on a table and are to be transferred in to a row of successive layers of sheets running transversely to it. In this arrangement, faster running belts are connected to the transverse transporter which place the individual layers a certain distance apart, that is to say separate the individual layers. It has been proposed that this transverse transportation takes place on the faster running belts by means of pushers which act on the layers transversely to their original transporting direction and pushes them over in unison. However, it may happen that the layers slide into each other, like playing cards during shuffling, and thus lead to disturbances. It is thus essential for the individual layers of sheets to follow each other, that is to say usually to be brought into contact with each other or brought to a certain constant distance from one another, so that a constant distance is ensured during the subsequent separation.

SUMMARY OF THE INVENTION

An object of the invention is to provide an apparatus of the type mentioned above which allows faster, more careful and less disruptive operation.

According to the invention there is provided an apparatus for transporting layers of sheets in which the layers of sheets are carried off discontinuously transversely to the direction in which they are supplied and follow the layers of sheets previously carried off, comprising a belt conveyor adapted to run at a substantially constant velocity, a belt run formed by upper and lower belts which is disposed upstream of the said belt conveyor and overlaps it at least in part, means for driving the belt run discontinuously at a velocity varying between standstill and a higher velocity than that of the belt conveyor, and means for varying cyclically the distance between the upper and lower belts.

With the invention, the layers of sheets are thus pushed in between the upper and lower belts of belt run which have been driven apart while the belt run is at a standstill. The distance between upper and lower belts is then reduced so that the layers are clamped between them and the belt run is started up. Owing to its higher velocity, the foremost layer of sheets in the row reaches the last layer of sheets in the previous row which travels on the slower running belt conveyor. The apparatus is now adjusted in such a way that the velocity of the belt run is preferably equal to that of the belt conveyor at this moment and the distance between the upper and lower belts in the belt run is again increased so that the layers of sheets can be released and carried by the belt conveyor while the belt run reduces its velocity further until stationary, whereupon a new row of layers of sheets may be pushed in. The invention is particularly advantageous with a long row of layers of sheets but a small number and possibly even only one layer of sheets could also be transported transversely.

In order to ensure good transfer in the overlapping region between belt conveyor and belt run, which is preferably about as long as the length of the transversely transported layers of sheets, the belt run is preferably composed of belts which are smooth in comparison to the belt conveyor. These can be, for example, toothed belts which normally have a smooth plastic surface. Slip-free and uniform running of upper and lower belts is also ensured by the toothed belts. The clamping of the layers of sheets between upper and lower belts ensures pulling in the region of the belt run even with smooth belts. However, if the belts are driven apart, then the layers of sheets are grasped and carried off by the somewhat rougher belt conveyor which is formed, for example, of textile belts and preferably has belts with a larger total area (or correspondingly more belts). A development in which the carrying run of the lower belt or belts of the belt run lies somewhat lower at least in the unloaded state than the carrying run of the belt conveyor also contributes to this.

Accurate transfer can be assisted by guiding the acting run of the upper belt of the belt run round a bend or a curve in the region of the overlap with the belt conveyor, with the belt travelling at an angle to the belt conveyor. A gradual delivery is thus created. This angle is preferably variable, that is to say both adjustable and periodic during a transporting stage. The end of the upper belt of the belt run lying in the transporting direction can preferably be raised and lowered independently of the section which is substantially parallel to the lower belt. In this case, the upper belt of the belt run therefore has a type of hinge by means of which the section of the upper belt lying in the transporting direction can only be lowered later than the remainder. It is thus simpler to carry off the portion of the layers of sheets still lying on the belt conveyor in the region of the overlapping stretch while the belt run in the region lying in front of it in the transporting direction already clamps the new layers of sheets again and begins transportation.

In a preferred embodiment, the transporting direction of the belt run is variable and a belt conveyor is arranged at each of its two ends. In this case, reversing of the belt run either selectively or automatically can therefore take place, so that, for example, one series of layers of sheets can be driven in one direction and the next in the other direction in order to follow the previous one. This is important for being able to double up a particularly slow operating unit for example in a total processing stretch or to simultaneously produce two different configurations of layers of sheets.

Other advantages and features of the invention will be apparent from the following description taken in conjunction with the drawings.

DETAILED DESCRIPTION OF PREFERRED EMBODIMENTS

Figure 1:
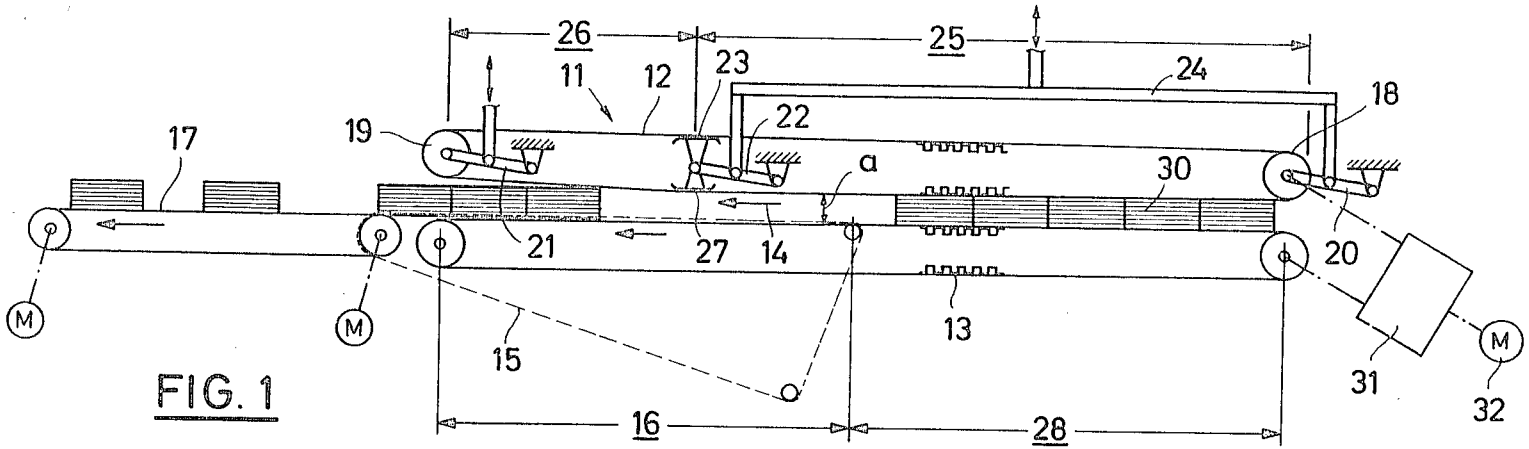
FIGS. 1 to 4 show various successive operating stages of an apparatus which is shown in a schematic side view.
Figure 2:
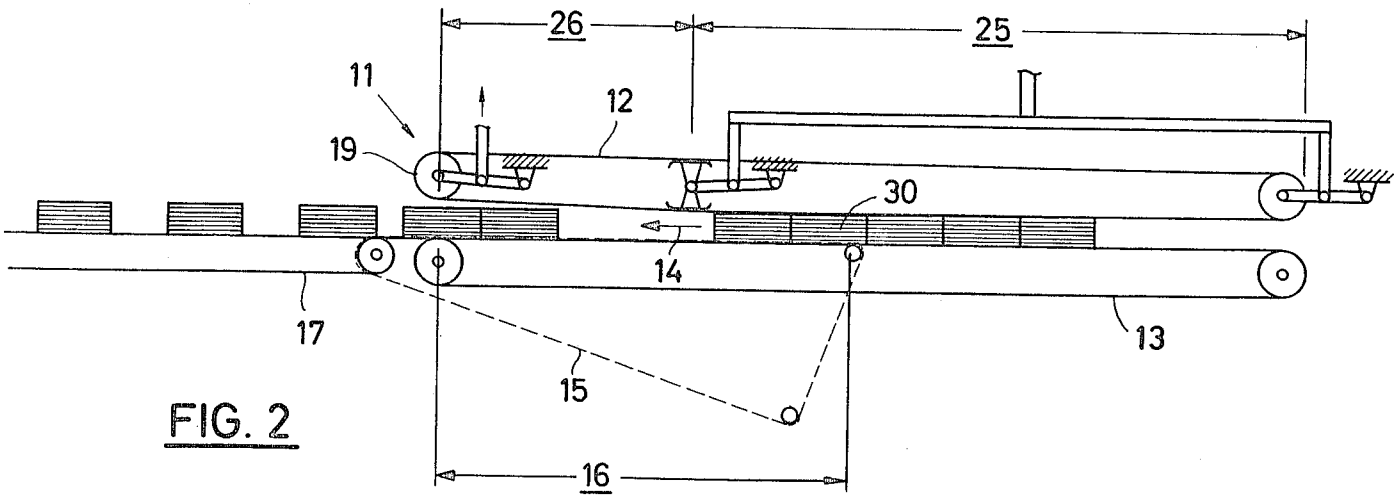

The apparatus shown schematically in FIGS. 1 to 4 comprises a belt run 11 which is composed of one or more upper belts 12 running parallel to each other and one or more lower belts 13. The upper and lower belts 12 and 13 are plastic toothed belts which have a smooth plastic outer surface. The belts 12 and 13 which run substantially parallel to each other over a relatively long stretch can be driven intermittently in the transporting direction indicated by arrow 14 (from right to left in the drawing), that is to say their adjacent runs travel in the transporting direction, by means of a drive motor 32 and a stop gear 31 which permits acceleration after a stationary phase and deceleration to stationary again.

A belt conveyor 15 is arranged in the downstream (i.e. lefthand) section of the belt run 11. The belt conveyor 15 forms a relatively large overlapping region 16 with the belt run 11. The majority of the effective carrying run of the belt conveyor 15 is included in the overlapping region 16. The belts 13 and 15 thus run parallel to each other, the belts 15 however preferably lying somewhat higher than the belts 13 at least in the unloaded state. The belt conveyor also has a larger belt surface since, for example, numerous individual belts may be arranged parallel to each other while the belt run 11 has only one upper and one lower belt parallel to each other. The belts of the belt conveyor 15 are made of a textile material which is therefore substantially rougher than the smooth material of the belts 12 and 13.

In so far as a distinction has been made between the term "belt run" and "belt conveyor", this is to provide a distinction in the context of this description. In particular, as shown in the drawings, the belt run could, if desired consist of several consecutive belts.

The belt conveyor 15 is driven continuously so that its carrying run also travels in the transporting direction 14. The continuous transporting velocity of the belt conveyor 15 is smaller than the maximum velocity to which the belts of the belt run 11 can be brought.

A belt 17 is connected to the belt conveyor 15 and is driven continuously at a higher velocity than the belt conveyor 15.

The distance a which is left between the belts 12 and 13 is variable. In the embodiments, the upper belt 12 is movably guided in a vertical direction by means of its drive and guide members for this purpose. In the schematic illustration of the drawing only two lateral deflecting rollers are shown. However, in reality numerous rollers or other guide means may be arranged over the length of the belts 12 and 13 which can also be provided with means for preventing sagging of the upper belts, for example magnets inserted into the tooth gaps of the toothed belts which co-operate with magnet yokes on the guide mechanism of the upper belt.

An upstream deflecting roller 18 and a downstream deflecting roller 19 are shown which are movable in a substantially vertical direction by means of mechanisms 20 and 21 of a raising and lowering apparatus shown as lever or hinge guide mechanisms respectively. A hinge 23 is also shown which is provided in the guide mechanism of the upper belt 12 and lies in the upstream section of the overlapping region 16. This hinge divides the upper belt into a parallel region 25 which runs substantially parallel to the lower belt 13 and an oblique downstream region 26 in which the belt 12 can assume an upward slant in the transporting direction. A bend or a curved section 27 can therefore be formed at the hinge.

The raising and lowering apparatus also comprises a mechanism 22 corresponding to the mechanism 20 and 21 which can raise and lower the belt in the hinge region and a connecting tie-bar 24 which connects the mechanisms 20 and 22 with each other for simultaneous and synchronous upward and downward movement of the parallel region 25.

The region lying upstream of the overlapping region 16 in the transporting direction is a pushing-in region 28 in which a row of layers of sheets 30 can be pushed transversely to the transporting direction 14, that is to say transversely to the plane in the drawings, by pushers or other conveyor belts. The layers of sheets can be pushed, for example, from a row of adjacent stacking devices on to the belt 13. In the present example, the row consists of five layers of sheets 30 which are adjacent during pushing in and consecutive in the transporting direction when carried off.

Figure 4:
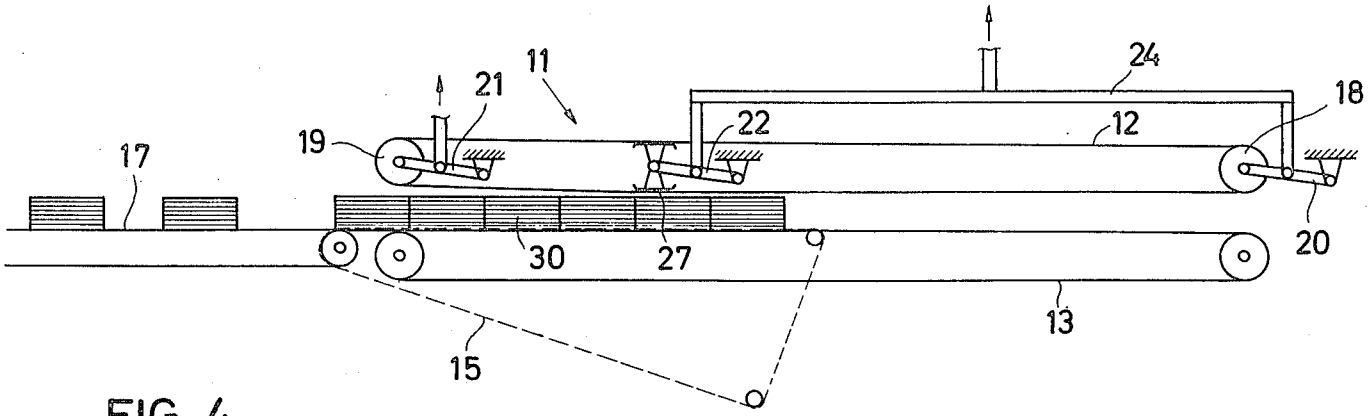
Figure 5:
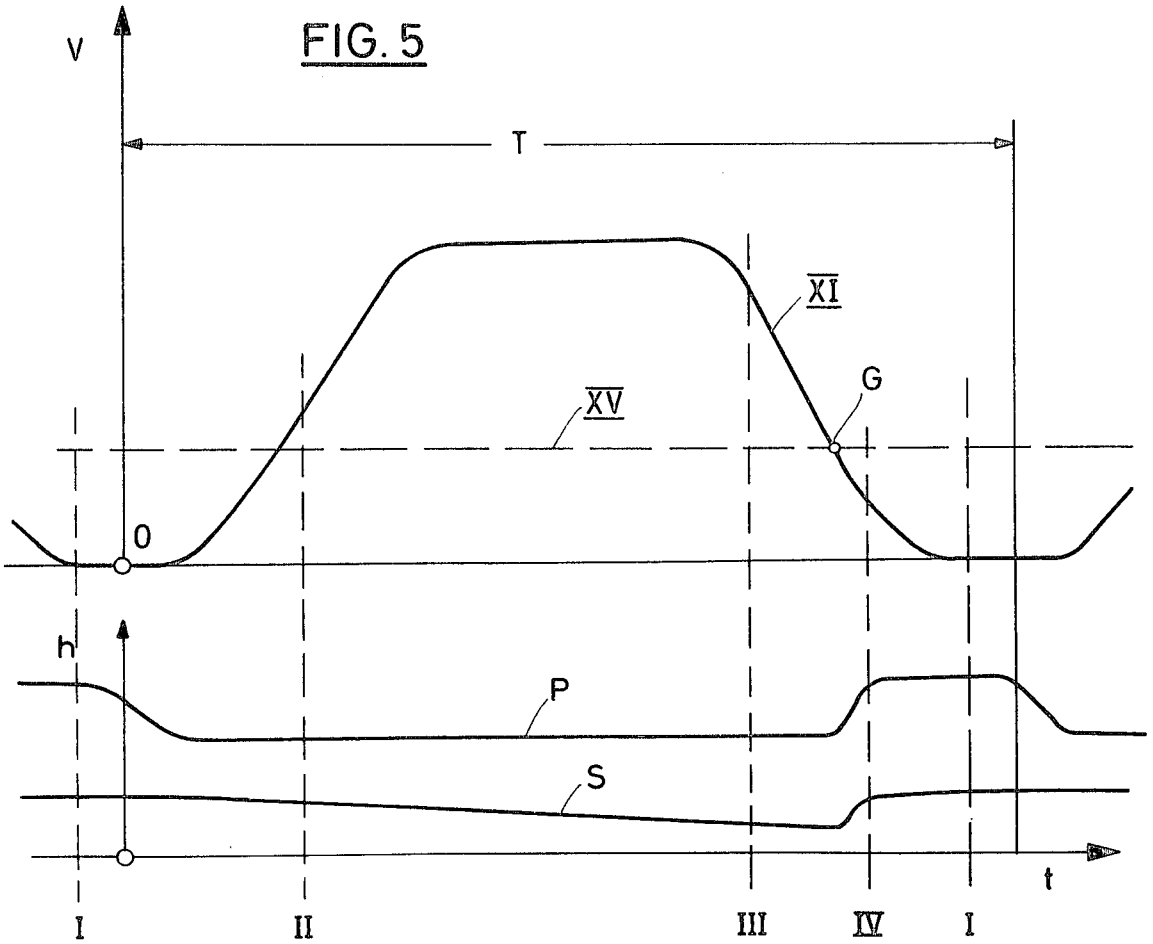
FIG. 5 shows a graph which represents the velocity V and the elevation h of the part of a belt run lying opposite the transporting direction and in the transporting direction over a time t.

FIG. 5 shows the paths of movement over a transporting phase T. The curve XI represents the velocity of the belt run 11, the broken line XV represents the constant velocity of the belt conveyor 15 and the curves P and S represent the amount of elevation h of the upper belt 12 of the belt run 11 leading to an increase in the distance a. The vertical dash-dotted lines I to IV denote the phases of movement shown in the corresponding FIGS. 1 to 4.

In FIG. 1 (line I in FIG. 5), the belt run 11 formed by the belts 12 and 13 is stationary. The upper belt 12 is raised both in its parallel region 25 (curve P) and in its oblique region 26 (curve S) so that the distance a is larger than the height of the layers of the sheets 30 and the layers of sheets lie only on the respective lower belts and are not touched by the upper belt. In this position, the row of layers of sheets is pushed on to the lower belt 13. The layers of sheets thus follow each other, that is to say they lie against each other. The layers of sheets transported in the transporting direction 14 in the previous operating stage are located in part still in the overlapping region, in part outside the overlapping region on the belt conveyor 15 and in part already on the rapidly running belt 17. The layers of sheets lying on the belt conveyor 15 (also in the overlapping region) are transported by the belt conveyor 15 at the velocity thereof as a consecutive row since the belts of the belt conveyor 15 are somewhat higher than the lower belt 13 of the belt run 11 and since the belts of the belt conveyor are rougher and possibly also have a larger surface area. This preferred pulling by the belt conveyor can, however, alternatively be achieved by only one of the above measures or by other means such as, for example, suction assistance. The stacks of sheets are separated when they run on to the rapid belt 17 to a distance defined exactly by the difference in velocity between the belts 15 and 17. This separation to a predetermined exact distance is performed with the aim of having the layers of sheets following each other closely, but there may be other reasons which demand a contacting position.

After pushing in, the parallel region 25 of the upper belt 12 is lowered so that the distance a diminishes and the layers of sheets are clamped between the upper and lower belts 12 and 13. The belt run 11 is accelerated by means of the stop gear 31 so that the layers of sheets are moved in the transporting direction 14 (the state shown in FIG. 2 and represented by II in FIG. 5). The oblique region 26 remains raised so that the previous layers of sheets still located at the end of the overlapping region 16 are unaffected by the movement of the belt run 11 because they are not touched by the upper belt 12. The lowering of the oblique region 26, as shown by curve S in FIG. 5, takes place progressively during the transportation of the layers of sheets.

Figure 3:
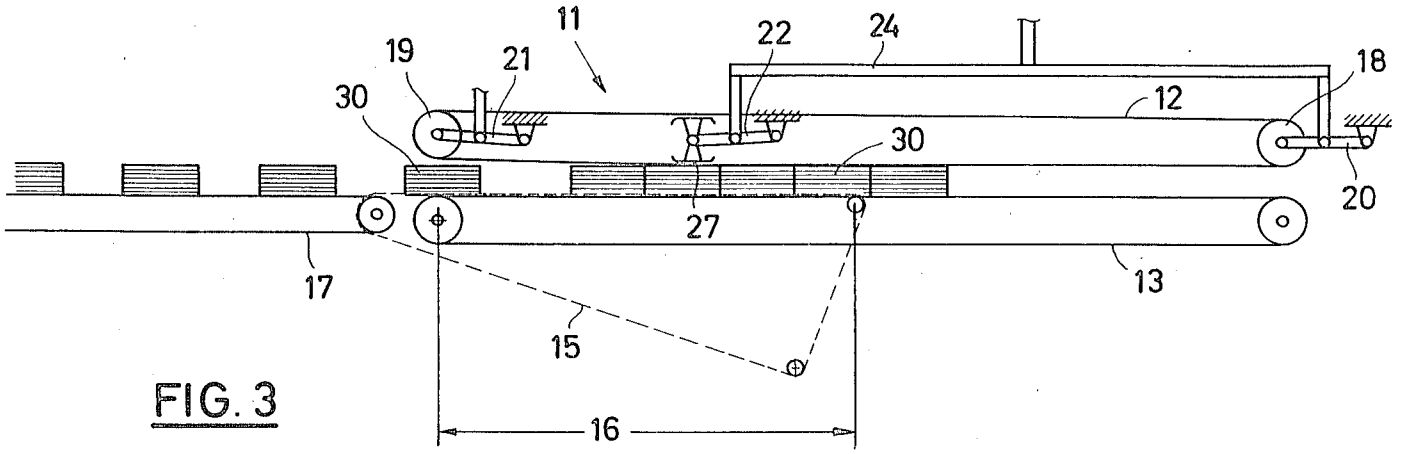

In the operating position in FIG. 3, the last layer of sheets 30 of the previous transporting stage has almost left the overlapping region 16, for which reason the end 19 of the belt 12 now also lying in the transporting direction can be substantially lowered. The last layer of sheets in the previous transporting stage has not yet reached the row of layers of sheets 30 transported by the belt run 11 but is located substantially in the overlapping region 16. Since the lower belt 13 and the upper belt 12 clamp the layers of sheets between them, they are moved at the substantially higher velocity of the belt run 11 in this region without being substantially braked in the overlapping region of the belt conveyor 15.

FIG. 4 shows an operating stage immediately after the one at which the following row of layers of sheets 30 has reached the last of the previous row. This preferably takes place exactly at moment G in FIG. 5 at which the velocity of the belt run 11 (XI) has decreased again to the velocity XV of the belt conveyor 15. At this moment, the raising and lowering apparatus 20, 21 and 22 lifts the entire upper belt on all sides so that contact between the layers of sheets 30 and the belt run 11 is lost and after contact of the layers of sheets in the two consecutive transporting stages, further conveyance is taken over by the belt conveyor 15. Fresh charging and thus a new transporting stage T can then commence (FIG. 1).

Figure 6:
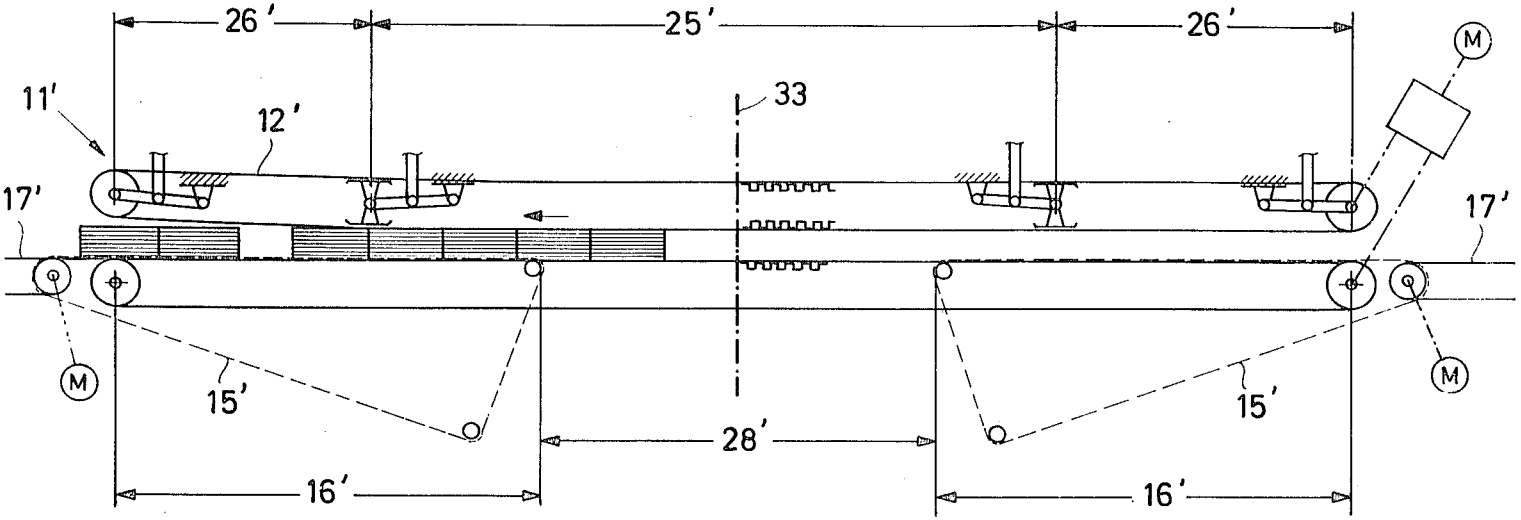
FIG. 6 is a schematic illustration showing a variation of the apparatus according to the invention with two mutually opposing transporting directions.

FIG. 6 shows a modified embodiment which consists of substantially the same components as the embodiment in FIG. 1. However, the apparatus is made up symmetrically substantially to a central line 33 forming the centre of the pushing-in region 28', that is to say the belt run 11' passes on each side of the pushing-in region 28' through an overlapping region 16' in each of which overlapping regions is arranged a belt conveyor 15' of the same structure as that shown in FIGS. 1 to 4, one being designed as a mirror image of the other. The upper belt 12' has a hinge on both sides and accordingly has an oblique region 26' while the parallel region 25' takes in the centre of the upper belt. The apparatus is followed by rapidly moving belt 17' on each side.

In the embodiment shown in FIG. 6, operation is identical to that in FIGS. 1 to 4 when conveyance is effected in one direction, for example to the left as shown in FIG. 6. Now, however two basic modes of operation are possible. Conveyance can either be performed normally to one side, for example to the left, and only exceptionally, for example during a stoppage in the subsequent machine, to the right, or one or more rows can be conveyed alternately to the right and the left in order to distribute the stream of layers of sheets. Whereas in the first case, for example, the right-hand conveyor and the subsequent belt 17' can normally be stationary, it can in the other case continue running constantly. If conveyance is effected alternately to the right and to the left, the belt run 11' would start running in the opposite direction after each stationary phase and push the row of layers of sheets alternately into one overlapping region and then the other. The fact that a larger interval in time between the transporting phases carried out in the respective direction exists owing to the alternate conveying may be compensated by suitable adaptation of the velocity and length of the belt conveyors 15'. The raising and lowering of the upper belt 12' can also operate similarly or differently in each transporting phase as a function of the mode of operation of the apparatus conveying toward the two sides, depending upon the side to which conveyance is performed. Thus, for example, with alternate conveyance to the two sides, the upper belt 12' should not be lowered or should be lowered to a lesser extent on the side which is not yet charged.

Numerous other modifications of the invention are possible. Thus, for example, the raising and lowering which is preferably controlled mechanically synchronously by means of cams can also be carried out by means of suitable control hydraulics. It is also possible to make up the belt run 11 from several successive belts, in particular in the case of FIG. 6 where separate belts may be present for right-hand or left-hand operation respectively. Although the drive is shown by independent motors in the drawings, this is only for clarification and the entire drive is normally performed via a synchronous shaft by means of preferably controllable gears.

I claim

1. An apparatus for transporting articles, comprising:

a belt conveyor adapted to run at a substantially constant velocity;

a belt run, formed by upper and lower belts, which is disposed upstream of the belt conveyor, although overlapping the belt conveyor at least in part;

means for intermittently driving the belt run at velocities different than that of the belt conveyor; and, means for cyclically increasing and decreasing the distance between the upper and lower belts for loading and engaging the articles, and for raising only the downstream end of the upper belt to release the articles in the overlapped region.

2. An apparatus according to claim 1, wherein the belt conveyor comprises a plurality of belts which are parallel to each other.

3. An apparatus according to claim 1, wherein the belt run is formed of belts which are smoother than the belt conveyor.

4. An apparatus according to claim 3, wherein the belt run is formed of toothed belts.

5. An apparatus according to claim 1, wherein the lower belt of the belt run has a carrying run which lies somewhat lower than an upper run of the belt conveyor, at least in an unloaded state.

6. An apparatus according to claim 1, wherein the means for increasing and decreasing the distance between the upper and lower belts comprises a raising and lowering apparatus for the upper belt of the belt run.

7. An apparatus according to claim 1, further comprising means for angularly raising the downstream end of the upper belt of the belt run around a bend in the overlapped region, with respect to the belt conveyor.

8. An apparatus according to claim 7, wherein the angle is variable.

9. An apparatus according to claim 1, further comprising means for raising and lowering the downstream end of the upper belt of the belt run independently of the rest of the upper belt which remains substantially parallel to the lower belt.

10. An apparatus according to claim 1, wherein the means for driving the belt run and the means for increasing and decreasing the distance between the upper and lower belts cooperate so that the upper belt is lowered at the end of the stationary phase and is raised when its velocity in a deceleration stage substantially coincides with that of the belt conveyor.

11. An apparatus according to claim 10, wherein the lowering of the downstream end of the upper belt of the belt run takes place with a deceleration over the lowering of the preceding substantially parallel region.

12. An apparatus according to claim 11, wherein the lowering of the downstream end of the upper belt of the belt run takes place progressively during the transporting stage of the belt run.

13. An apparatus according to claim 11, wherein the downstream end of the upper belt of the belt run may be raised substantially simultaneously with the substantially parallel region.

14. An apparatus according to claim 1, wherein the conveying direction of the belt run is variable, and comprising a belt conveyor is arranged on each of its two sides.

15. An apparatus according to claim 1, wherein the belt run is driven at velocities varying from standstill to a higher velocity than that of the belt conveyor.

16. An apparatus according to claim 1 or 15, wherein the articles conveyed are stacks of sheets.

* * * * *